US010191432B2

(12) United States Patent
Hamahashi

(10) Patent No.: US 10,191,432 B2
(45) Date of Patent: Jan. 29, 2019

(54) IMAGE FORMING APPARATUS AND IMAGE FORMING METHOD INCLUDING PRE-FEEDING OF A RECORDING MEDIUM

(71) Applicant: Shunsuke Hamahashi, Hyogo (JP)

(72) Inventor: Shunsuke Hamahashi, Hyogo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/600,221

(22) Filed: Jan. 20, 2015

(65) Prior Publication Data

US 2015/0212472 A1 Jul. 30, 2015

(30) Foreign Application Priority Data

Jan. 27, 2014 (JP) ..... 2014-012645

(51) Int. Cl.
*G03G 15/00* (2006.01)
*B41J 29/38* (2006.01)

(52) U.S. Cl.
CPC ..... *G03G 15/6552* (2013.01); *G03G 15/6511* (2013.01); *G03G 15/6502* (2013.01); *G03G 15/6564* (2013.01)

(58) Field of Classification Search
None
See application file for complete search history.

(56) References Cited

U.S. PATENT DOCUMENTS 4,974,019 A * 11/1990 Nishioka ..... B65H 7/02 271/265.02
2007/0052163 A1* 3/2007 Sasaki ..... B65H 1/14 271/238
2007/0120313 A1* 5/2007 Wada ..... B65H 19/18 271/9.02
2007/0183827 A1* 8/2007 Terashita ..... G03G 15/6502 399/391
2008/0273884 A1* 11/2008 Yokobori ..... G03G 15/5012 399/21
2009/0166964 A1* 7/2009 Fukasawa ..... B41J 11/0095 271/265.01

(Continued)

FOREIGN PATENT DOCUMENTS

JP 2000168974 A 6/2000
JP 2004-315220 11/2004

(Continued)

OTHER PUBLICATIONS

Extended European Search Report dated Sep. 2, 2015.

*Primary Examiner* — Blake A Tankersley
*Assistant Examiner* — Ruben C Parco, Jr.
(74) *Attorney, Agent, or Firm* — Harness, Dickey & Pierce, P.L.C.

(57) ABSTRACT

An image forming apparatus includes a storage unit configured to store a recording medium; a conveyance unit configured to convey the recording medium from the storage unit; an image formation unit configured to perform an image formation for forming an image to be transferred onto the recording medium conveyed from the storage unit; and a detection unit configured to detect a start of the image formation. Upon the detection unit detecting the start of the image formation, the conveyance unit moves the recording medium by a predetermined distance from the storage unit.

9 Claims, 11 Drawing Sheets

(56) References Cited

U.S. PATENT DOCUMENTS

| | | | | |
|---|---|---|---|---|
| 2011/0050825 | A1* | 3/2011 | Murata | B41J 11/007 347/104 |
| 2011/0134460 | A1 | 6/2011 | Shibata | |
| 2011/0215518 | A1* | 9/2011 | Ushiyama | B65H 1/00 271/145 |
| 2011/0218669 | A1* | 9/2011 | Matsumoto | B65H 5/26 700/214 |
| 2011/0291353 | A1 | 12/2011 | Fujiwara et al. | |
| 2012/0195665 | A1 | 8/2012 | Tajiri | |

FOREIGN PATENT DOCUMENTS

| | | | |
|---|---|---|---|
| JP | 2006076671 | A | 3/2006 |
| JP | 2008-052125 | | 3/2008 |
| JP | 2011121207 | A | 6/2011 |
| JP | 2011-235985 | | 11/2011 |

* cited by examiner

IMAGE FORMING APPARATUS AND IMAGE FORMING METHOD INCLUDING PRE-FEEDING OF A RECORDING MEDIUM

BACKGROUND OF THE INVENTION

1. Field of the Invention

The disclosures herein generally relate to an image forming apparatus and an image forming method.

2. Description of the Related Art

Conventionally, methods of detecting states of paper jams (hereinafter, referred to as a "jam"), in which recording media are not fed or ejected normally as jam errors, have been known.

For example, Japanese Published Patent Application No. 2011-235985 discloses a method of adjusting a permissible feeding time or a number of feeding retries that detects a jam taking account of the abrasion of feeding rollers from an accumulated number of occurrences of paper nonfeeding jams or the like.

Furthermore, Japanese Published Patent Application No. 2004-315220 discloses an image forming apparatus provided with two paper feeding paths. In the image forming apparatus disclosed in Japanese Published Patent Application No. 2004-315220, even if a jam occurs in one of the paper feeding paths, conveyance of the recording medium can be performed by using another paper feeding path.

However, in the method disclosed in Japanese Published Patent Application No. 2011-235985, since a recording medium is not conveyed upon starting image formation, delay of conveyance of a recording medium is likely to be erroneously detected as a jam.

SUMMARY OF THE INVENTION

It is a general objective of at least one embodiment of the present invention to provide an image forming apparatus and an image forming method that substantially obviates one or more problems caused by the limitations and disadvantages of the related art.

In one embodiment, an image forming apparatus includes a storage unit configured to store a recording medium; a conveyance unit configured to convey the recording medium from the storage unit; an image formation unit configured to perform an image formation for forming an image to be transferred onto the recording medium conveyed from the storage unit; and a detection unit configured to detect a start of the image formation. Upon the detection unit detecting the start of the image formation, the conveyance unit moves the recording medium by a predetermined distance from the storage unit.

In another embodiment, an image forming method in an image forming apparatus including a storage unit for storing a recording medium includes conveying the recording medium from the storage unit; performing an image formation for forming an image to be transferred onto the recording medium conveyed from the storage unit; and detecting a start of the image formation. Upon the start of the image formation being detected, the recording medium is moved by a predetermined distance from the storage unit.

According to an embodiment of the present invention, an image forming apparatus and an image forming method that detect a jam accurately are provided.

BRIEF DESCRIPTION OF THE DRAWINGS

Other objects and further features of embodiments will be apparent from the following detailed description when read in conjunction with the accompanying drawings, in which.

DESCRIPTION OF THE PREFERRED EMBODIMENTS

In the following, embodiments of the present invention will be described with reference to the accompanying drawings.

<First Embodiment>

<Entire Configuration of Image Forming Apparatus>

Figure 1:
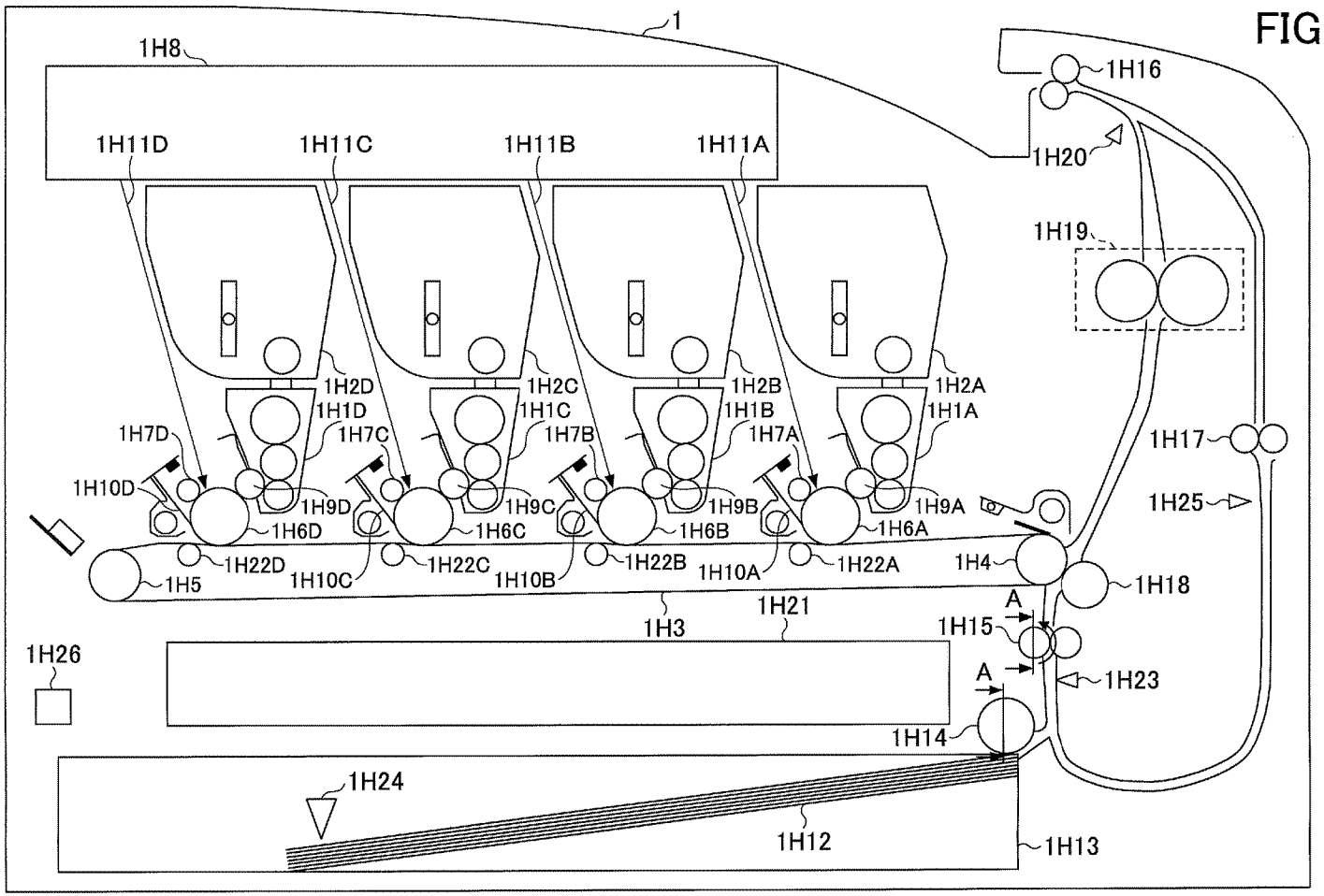
FIG. 1 is a diagram illustrating an example of an entire configuration of an image forming apparatus according to a first embodiment of present invention.

FIG. 1 is a diagram illustrating an example of an entire configuration of an image forming apparatus according to a first embodiment;

An image forming apparatus 1 is an electrophotographic image forming apparatus provided with a secondary transfer mechanism called a "tandem system" in forming a color image. In the following, it will be explained referring to FIG. 1 as an example.

The image forming apparatus 1 includes developing units of respective colors 1H1A, 1H1B, 1H1C and 1H1D, toner containers of the respective colors 1H2A, 1H2B, 1H2C and 1H2D, and a transfer belt 1H3. The image forming apparatus 1 further includes a transfer belt driving roller 1H4, and a transfer belt tension roller 1H5.

The developing units of the respective colors 1H1A, 1H1B, 1H1C and 1H1D, the toner containers of the respective colors 1H2A, 1H2B, 1H2C and 1H2D are arranged, for example, along the transfer belt 1H3.

The developing units 1H1A, 1H1B, 1H1C and 1H1D and the toner containers 1H2A, 1H2B, 1H2C and 1H2D correspond to the respective colors. The colors include, for example, yellow (Y), cyan (C), magenta (M), black (K) or the like. (In the following, with symbols shown in the parentheses, they may appropriately indicate the colors.

The transfer belt 1H3 is retained by the transfer belt driving roller 1H4 and the transfer belt tension roller 1H5, and is driven by a rotation of the transfer belt driving roller 1H4.

The developing unit 1H1A is provided with a photoconductor 1H6A, a charging unit 1H7A, an exposure unit 1H8, a developing device 1H9A and a cleaner blade 1H10A.

The charging unit 1H7A, the exposure unit 1H8, the developing device 1H9A and the cleaner blade 1H10A are arranged at the periphery of the photoconductor 1H6A.

Since the developing units 1H1B, 1H1C and 1H1D have the same configuration as the developing unit 1H1A, the explanations will be omitted.

The exposure units 1H8 emits laser lights corresponding to respective colors 1H11A, 1H11B, 1H11C and 1H11D.

The image forming apparatus 1 includes a paper feeding tray 1H13, a paper feeding roller 1H14, a registration roller 1H15, a paper ejection roller 1H16, a double-sided roller 1H17 and a secondary transfer roller 1H18. The image forming apparatus 1 further includes a fixing device 1H19, a paper ejection sensor 1H20, a waste toner box 1H21, primary transfer roller of the respective colors 1H22A, 1H22B, 1H22C and 1H22D. Furthermore, the image forming apparatus 1 further includes a registration sensor 1H23, a recording medium amount sensor 1H24, a double-sided sensor 1H25 and a door opening/closing sensor 1H26.

The paper feeding tray 1H13 accommodates recording media 1H12. The recording media 1H12 include, for example, papers, high-quality papers, plastic sheets, metallic sheets or the like.

The paper feeding roller 1H14 is a mechanism for feeding a recording medium 1H12 from the paper feeding tray 1H13.

The registration roller 1H15 is a mechanism for conveying the recording medium 1H12 fed by the paper feeding roller 1H14 to the secondary transfer roller 1H18.

Details of the paper feeding roller 1H14 and the registration roller 1H15 will be described later.

The paper ejection roller 1H16 is a mechanism for ejecting the recording medium 1H12 from the image forming apparatus 1.

The double-sided roller 1H17 is a mechanism for conveying the recording medium 1H12, upon performing the image formation on both sides of the recording medium 1H12, so that after the image formation is performed on one side of the recording medium 1H12 the image formation is performed on the other side of the recording medium 1H12.

The secondary transfer roller 1H18 is a mechanism for performing a so-called "secondary transfer", i.e. transferring an image formed on the transfer belt 1H3 onto the recording medium 1H12.

The fixing device 1H19 is a device for fixing toners transferred on the recording medium 1H12 by the secondary transfer.

The paper ejection sensor 1H20 is a sensor for detecting the recording medium 1H12 to be ejected by the paper ejection roller 1H16.

The waste toner box 1H21 is a container for collecting a pattern formed on the transfer belt 1H3 or toners remaining on the transfer belt 1H3 which was not transferred onto the recording medium 1H12.

Details of the registration sensor 1H23, the recording medium amount sensor 1H24, the double-sided sensor 1H25 and the door opening/closing sensor 1H26 will be described later.

<Outline of Operation of Image Forming Apparatus>

The image forming apparatus 1, upon performing the image formation, charges the photoconductors of the respective colors 1H6A, 1H6B, 1H6C and 1H6D by the charging units 1H7A, 1H7B, 1H7C and 1H7D, respectively.

The exposure unit 1H8 emits laser lights 1H11A, 1H11B, 1H11C and 1H11D on the charged photoconductors 1H6A, 1H6B, 1H6C and 1H6D, performs exposure and forms electrostatic latent images, respectively.

The developing devices 1H9A, 1H9B, 1H9C and 1H9D stick toners to the electrostatic latent images formed on the photoconductors 1H6A, 1H6B, 1H6C and 1H6D, performs developing and forms toner images, respectively.

Next, a so-called "primary transfer" is performed for the toner images by the photoconductors 1H6A, 1H6B, 1H6C and 1H6D contacting with the transfer belt 1H3. The primary transfer is performed by the primary transfer rollers of the respective colors 1H22A, 1H22B, 1H22C and 1H22D. The toner images are formed on the transfer belt 1H3 by the primary transfer.

After the primary transfer ends, toners remaining on the photoconductors 1H6A, 1H6B, 1H6C and 1H6D are removed by the cleaner blades 1H10A, 1H10B, 1H10C and 1H10D, respectively.

A toner image formed in the developing unit 1H1A is conveyed to the next developing unit 1H1B by the transfer belt 1H3. Similarly, the developing units 1H1B, 1H1C and 1H1D perform transfers so that toner images of the respective colors are superimposed upon each other. By the developing units 1H1A, 1H1B, 1H1C and 1H1D a full-color toner image is formed.

The full-color toner image formed on the transfer belt 1H3 is conveyed to the secondary transfer roller 1H18 that performs the secondary transfer by the transfer belt 1H3.

The recording medium 1H12 is conveyed from the paper feeding tray 1H13 to the registration roller 1H15 by the paper feeding roller 1H14. The conveyed recording medium 1H12 is further conveyed to the secondary transfer roller 1H18 that performs the secondary transfer by the registration roller 1H15.

The conveyance of the recording medium 1H12 by the registration roller 1H15 and the conveyance of the toner image by the transfer belt 1H3 are performed at a timing that the toner image is transferred onto the recording medium 1H12 at a predetermined position. That is, at the timing that the recording medium 1H12 and the toner image overlap each other at a position of the secondary transfer roller 1H18 that performs the secondary transfer, the registration roller 1H15 and the transfer belt driving roller 1H4 start driving.

The secondary transfer roller 1H18 performs the secondary transfer for the toner image on the transfer belt 1H3 onto the recording medium 1H12 conveyed by the registration roller 1H15. The fixing device performs a fixing process, such as heating or pressurizing for the recording medium 1H12 on which the secondary transfer is performed.

The recording medium 1H12 on which the fixing process is performed is ejected to the outside of the image forming apparatus 1 by the paper ejection roller 1H16.

In the case of the so-called "double-sided printing", the recording medium 1H12 on which the fixing process is performed is conveyed to the registration roller 1H15 by the double-sided roller 1H17. The recording medium 1H12 conveyed to the registration roller 1H15 is conveyed by the registration roller 1H15 again. For the recording medium 1H12 conveyed by the registration roller 1H15 again the secondary transfer and the fixing process are performed on the side where the image formation has not been performed. Then, the recoding medium 1H12 is ejected to the outside of the image forming apparatus 1 by the paper ejection roller 1H16.

The developing units of the respective colors 1H1A, 1H1B, 1H1C and 1H1D are provided with toner amount sensors (not shown) for detecting amounts of toners. The toner amount sensor determines whether the amount of toner in the developing unit is less than or equal to a predetermined amount. In the case where it is determined that the amounts of toners in the developing units are less than or equal to the predetermined amount, toners are supplied from the toner containers of the respective colors 1H2A, 1H2B, 1H2C and 1H2D.

<Mechanism of Paper Feeding Roller and Registration Roller>

Figure 2:
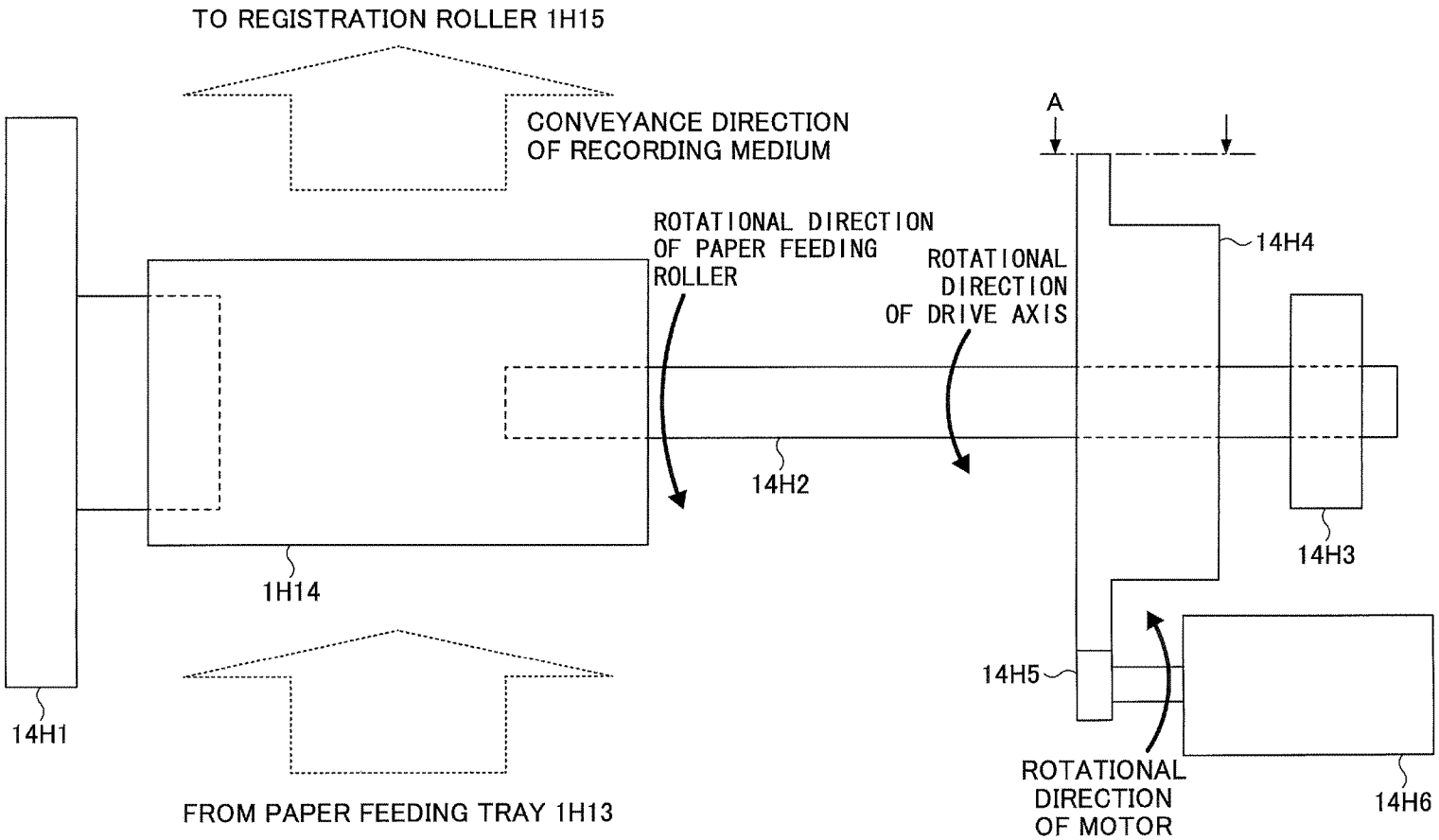
FIG. 2 is a diagram illustrating an example of configurations of a feed roller, a registration roller and peripheral mechanism according to the first embodiment.

FIG. 2 is a diagram for explaining an example of a configuration of the paper feeding roller, the registration roller and peripheral mechanism according to the first embodiment.

FIG. 2 is a diagram illustrating the configuration of the paper feeding roller, the registration roller and the peripheral mechanism viewed from the direction "A" shown in FIG. 1. FIG. 2 is a pattern diagram where the respective mechanism elements are simplified.

Since the configuration of the paper feeding roller 1H14 and the peripheral mechanism is the same as the configuration of the registration roller 1H15 and the peripheral mechanism, the case of the paper feeding roller 1H14 will be explained as an example, and an explanation for the case of the registration roller 1H15 will be omitted.

The peripheral mechanism of the paper feeding roller 1H14 includes, for example, a paper feeding roller supporting member 14H1, a drive axis 14H2, a shaft supporting member 14H3, a clutch 14H4, a reducer 14H5 and a motor 14H6.

At one end of the paper feeding roller 1H14, the paper feeding roller supporting member 14H1 engages. At the other end of the paper feeding roller 1H14, the drive axis 14H2 engages. The paper feeding roller 1H14 is supported by the paper feeding roller supporting member 14H1 and the drive axis 14H2. The paper feeding roller 1H14 has a mechanism of rotating along with a rotation of the drive axis 14H2 in the case where a torque is input to the drive axis 14H2.

The paper feeding roller 1H14 contacts with a recording medium 1H12. In the case where the paper feeding roller 1H14 rotates, a friction is generated between the paper feeding roller 1H14 and the recording medium 1H12 with which the paper feeding roller 1H14 is contacted, and the recording medium 1H12 is conveyed according to the friction.

The drive axis 14H2 has the clutch 14H4. The drive axis 14H2 is rotates or stops by a torque from the motor 14H6 according to a clutch control, which will be described later.

A source of driving, for example, is the motor 14H6. In the following, the case where the source of driving is the motor 14H6 will be explained as an example. The motor 14H6 is a so-called "actuator", and generates a torque when an electric power is input. The torque generated by the motor 14H6 is transmitted by the reducer 14H5. The torque transmitted to the reducer 14H5 is transmitted to the drive axis 14H2 via the clutch 14H4, and a force to rotate the drive axis 14H2 is generated.

The clutch 14H4 switches an operation of transmitting the torque from the reducer 14H5 to the drive axis 14H2 to rotate the drive axis 14H2 and an operation of cutting off the torque from the reducer 14H5 to stop the rotation of the drive axis 14H2, according to the clutch control which will be described later.

<Clutch Control>

Figure 3B:
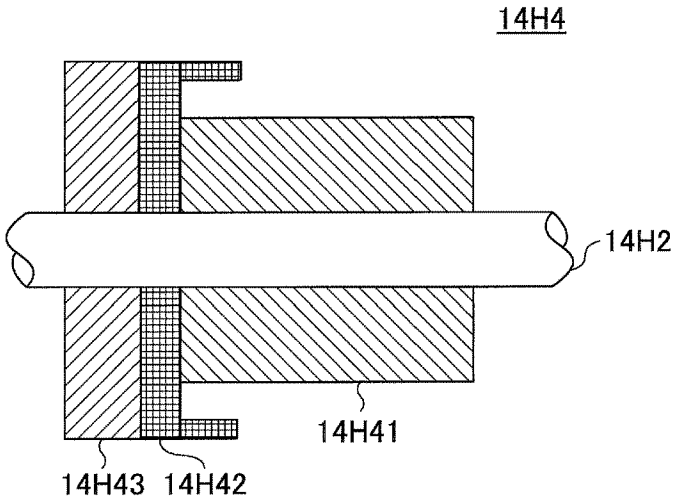
FIGS. 3A and 3B are cross-sectional diagrams illustrating an example of a clutch control according to the first embodiment.
Figure 3A:
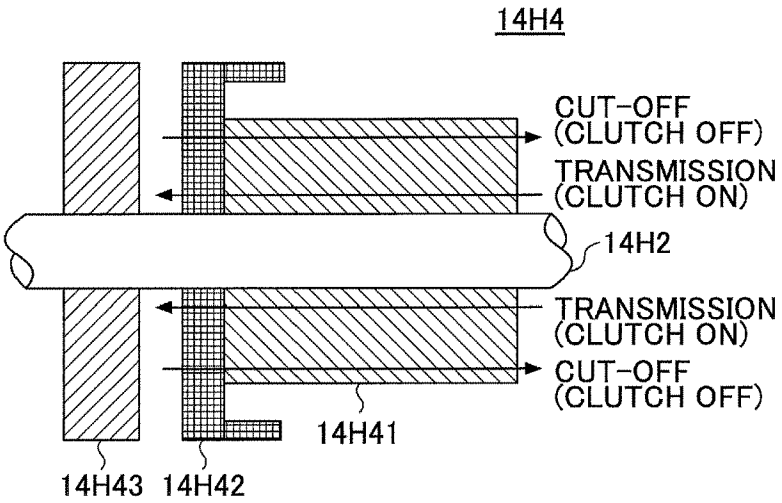

FIGS. 3A and 3B are cross-sectional diagrams for explaining an example of the clutch control according to the first embodiment.

FIGS. 3A and 3B are cross-sectional diagrams illustrating the clutch 14H4 viewed from the direction "A" shown in FIG. 2. A configuration of the clutch 14H4 shown in the cross-sectional diagrams of FIGS. 3A and 3B will be explained as an example in the following.

FIG. 3A is a cross-sectional diagram for explaining an example of the configuration and operation of the clutch.

The clutch 14H4 includes, for example, a coil 14H41, a rotor 14H42 and a gear 14H43.

The clutch 14H4 performs switching by moving the coil 14H41 as shown by arrows in FIG. 3A. In the case where the torque from the motor 14H6 is transmitted to the drive axis 14H2, the clutch 14H4 moves the coil 14H41 to the direction toward the gear 14H43 so that the rotor 14H42 contacts with the gear 43 (hereinafter, referred to as "clutch ON").

In the case of cutting off the torque of the motor 14H6 from the drive axis 14H2, the clutch 14H2 moves the coil 14H41 to the direction away from the gear 14H43 so as to separate the rotor 14H42 from the gear 14H43 (hereinafter, referred to as "clutch OFF").

To the rotor 14H42 the torque from the motor 14H6, shown in FIG. 2, is transmitted.

The gear 14H43 engages with the drive axis 14H2. When a torque is input to the gear 14H43, the drive axis 14H2 is rotated.

FIG. 3B is a cross-sectional diagram for explaining an example of the case of the clutch ON.

In the case of the clutch ON, the rotor 14H42 contacts with the gear 14H43, the torque transmitted from the motor 14H6 shown in FIG. 2 to the rotor 14H42 is transmitted to the gear 14H43, and the drive axis 14H2 rotates.

In order to configure the clutch as shown in FIG. 3B, the clutch 14H4 inputs an electric current to the coil 14H41. When the electric current is input to the coil 14H41, the coil 14H41 and the rotor 14H42 move toward the gear 14H43 according to an electromagnetic force.

Accordingly, depending on whether to activate the coil 14H41, the clutch 14H4 controls rotating the drive axis 14H2 and stopping the rotation.

Details of control signals for performing the control of the rotation of the drive axis 14H2 and of the stopping of the rotation will be described later.

<Hardware Configuration for Performing Control>

Figure 4:
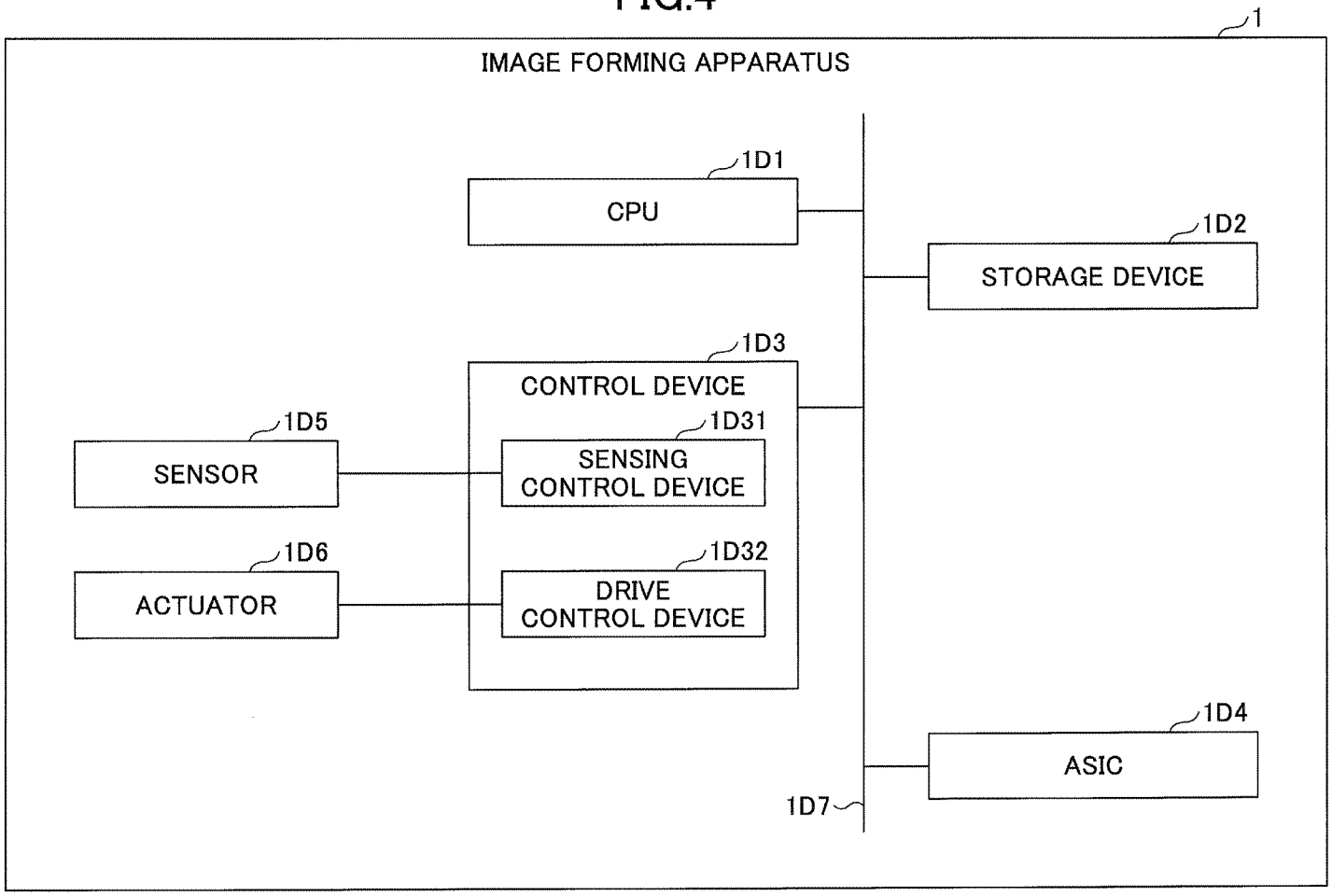
FIG. 4 is a block diagram illustrating an example of a configuration of hardware for controlling the image forming apparatus according to the first embodiment.

FIG. 4 is a block diagram for explaining an example of a configuration of hardware for controlling the image forming apparatus according to the first embodiment.

The image forming apparatus 1 includes, for example, an electronic circuit substrate (not shown) and is controlled by hardware configured as shown in FIG. 4 on the electronic circuit substrate.

The image forming apparatus 1 includes a CPU (central processing unit) 1D1, a storage device 1D2 and a control device 1D3. The image forming apparatus 1 further includes an ASIC (application specific integrated circuit) 1D4, a sensor 1D5 and an actuator 1D6. The respective elements included in the image forming apparatus 1 are connected via a bus 1D7, and data, signals or the like are sent to or received from each other.

Meanwhile, connection to the bus 1D7 may be a configuration of a connection via a bridge circuit (not shown). Moreover, the configuration of the image forming apparatus 1 is not limited to the connection configuration shown in FIG. 4. For example, the image forming apparatus 1 may be configured so that plural buses are provided and a configuration element, which performs a process according to a fast transmission, such as an input to/output from the CPU 1D1 and configuration element, which performs a process according to a slow transmission, such as an input interface device (not shown) are connected to different buses, respectively.

The CPU 1D1 performs various processes that the image forming apparatus 1 performs. For example, the CPU 1D1 acquires data or a program stored in the storage device 1D2, which will be described later, via the bus 1D7. Moreover, the CPU 1D1 outputs an instruction, a parameter or the like to the control device 1D3 and the ASIC 1D4, which will be described later, via the bus 1D7, thereby controlling the entire image forming apparatus 1.

Meanwhile, the CPU 1D1 may be configured by plural devices or plural cores so as to speed up processes by parallel processing. Moreover, the process by the CPU 1D1 may be performed by distributed processing or parallel processing wherein a separated hardware resource (not shown) is provided inside or outside the image forming apparatus 1 and assists the CPU 1D1.

The storage device 1D2 is a so-called "main storage unit", an "auxiliary storage unit" or the like, such as a memory, a register, a hard disk (HD) or the like, which is provided with a storage area and a control device. The storage device 1D2 stores, for example, information such as various data including intermediate results of processes based on the control by the CPU 1D1, parameters or programs.

The control device 1D3 performs control for various devices included in the image forming apparatus 1. The control device 1D3 includes, for example, a sensing control device 1D31 and a drive control device 1D32.

The sensing control device 1D31 controls the sensor 1D5. The drive control device 1D32 controls the actuator 1D6.

The sensor 1D5 includes, for example, the paper ejection sensor 1H20, shown in FIG. 1, the registration sensor 1H23, the recording medium amount sensor 1H24, the double-sided sensor 1H25 and the door opening/closing sensor 1H26. The respective sensors detect the presence or absence of the recording medium 1H12. For example, the registration sensor 1H23 detects whether a recording medium 1H12 is conveyed to the registration roller, shown in FIG. 1. In the case where the recording medium 1H12 is conveyed to the registration roller in FIG. 1, the registration sensor 1H23 outputs a signal of a predetermined potential. The sensing control device 1D31 performs a process such as A/D conversion and detects whether the recording medium 1H12 is conveyed to the registration roller in FIG. 1 based on the signal output from the registration sensor 1H23.

Similarly, the paper ejection sensor 1H20 in FIG. 1 and the sensing control device 1D31 detect whether the recording medium 1H12 is conveyed to the paper ejection roller 1H16 in FIG. 1.

The double-sided sensor 1H25 in FIG. 1 and the sensing control device 1D31 detect whether the recording medium 1H12 is conveyed to the double-sided roller 1H17 in FIG. 1.

The recording medium amount sensor 1H24 in FIG. 1 and the sensing control device 1D31 detect whether the paper feeding tray 1H13 in FIG. 1 accommodates a predetermined amount of recording media 1H12.

The door opening/closing sensor 1H26 and the sensing control device 1D31 detect whether a door on the front surface (not shown) of the image forming apparatus 1 is opened or closed. In the case of inserting recording media 1H12 into the paper feeding tray 1H13, a user or an administrator of the image forming apparatus 1 operates while opening the door on the front surface of the image forming apparatus 1. That is, in the case where it is detected that the door on the front surface of the image forming apparatus 1 is opened, it is the state where the user or the administrator is inserting the recording media 1H12 into the paper feeding tray 1H13. In the case where it is detected that the door on the front surface of the image forming apparatus 1 is closed, it is the state where the user or the administrator finishes the operation of inserting the recording media 1H12.

Meanwhile, the sensor 1D5 may be a configuration for measuring other environment. For example, the image forming apparatus 1 may include sensors for measuring a temperature or a humidity at various places inside the apparatus, and change parameters in the respective processes based on the measured temperature or humidity.

Meanwhile, the actuator 1D6 is, for example, the clutch 14H4 in FIG. 2 and the motor 13H6 in FIG. 2.

The drive control device 1D32, for example, controls the actuator 1D6 according to the drive control signal, which will be described later. The drive control device 1D32, for example, based on an instruction from the CPU 1D1, controls the clutch 14H4, and controls the conveyance of the recording medium 1H12 by the paper feeding roller 1D14 in FIG. 1, the registration roller 1H15 and the like.

The ASIC 1D4 is a processing circuit for performing specific processing, such as image processing, for example. Based on the instruction from the CPU 1D1, for example, the ASIC 1D4 performs processing for generating image data for an image formed on the recording medium 1H12.

Meanwhile, the ASIC 1D4 is not limited to an ASIC. The ASIC 1D4 may be realized by, instead of an ASIC, an FPGA (Field-Programmable Gate Array), a CPLD (Complex Programmable Logic Device) or the like.

Meanwhile, the hardware configuration for performing the control is not limited to the configuration shown in FIG. 4. For example, the control device 1D3 may be a configuration for receiving an instruction or data from a device (not shown) other than the CPU 1D1, and operating.

<Functional Configuration>

Figure 5:
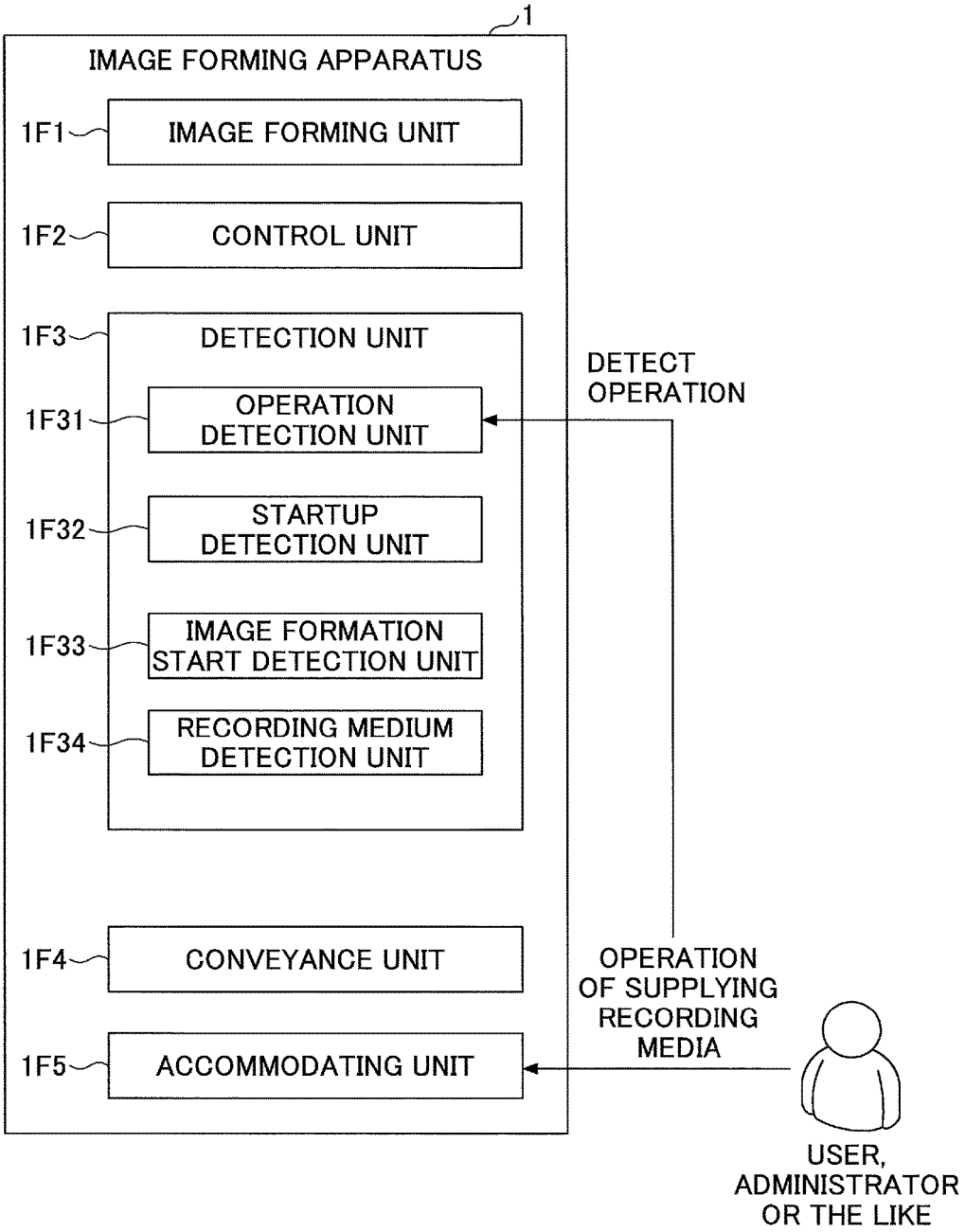
FIG. 5 is a functional block diagram illustrating an example of a functional configuration of the image forming apparatus according to the first embodiment.

FIG. 5 is a functional block diagram for explaining an example of a functional configuration of the image forming apparatus according to the first embodiment.

The image forming apparatus 1 includes an image forming unit 1F1, a control unit 1F2, a detection unit 1F3, a conveyance unit 1F4 and an accommodating unit 1F5.

The image forming unit 1F1 performs various types of processes for forming an image on a recording medium 1H12, such as charging/neutralizing, exposure, developing, transfer, fixing, cleaning and the like.

The image forming unit 1F1 includes, for example, developing units 1H1A, 1H1B, 1H1C and 1H1D; a transfer belt 1H3; a secondary transfer roller 1H18; a fixing unit 1H19; a CPU 1D1; a control device 1D3 and the like.

The control unit 1F2 controls the respective devices, with which the image forming apparatus 1 is provided, to realize the respective processes. The control unit 1F2 includes, for example, the CPU 1D1, the control device 1D3 and the like. Details of controls, which the control unit 1F2 performs, and timings of the controls will be described later.

The detection unit 1F3 detects a position/status, a status of the control unit 1D2, an operation by a user/administrator or the like.

The detection unit 1F3 includes an operation detection unit 1F31, a startup detection unit 1F32, an image formation start detection unit 1F33 and a recording medium detection unit 1F34.

The operation detection unit 1F31 includes, for example, the door opening/closing sensor 1H26 in FIG. 1, the sensing control device 1D31 in FIG. 1 and the like. The operation detection unit 1F31 detects, for example, an operation of the user, the administrator or the like supplying recording media 1H12 to the paper feeding tray 1H13 in FIG. 1. For example, the operation detection unit 1F31 detects an open state or a close state of the door (not shown) provided in the image forming apparatus 1 by the door opening/closing sensor 1H26 in FIG. 1. In the case where it is detected that the door is opened, the operation detection unit 1F31 determines that the operation of supplying recording media 1H12 to the paper feeding tray 1H13 in FIG. 1 by the user, the administrator or the like is performed. In the case where it is detected that the open state transitions to the close state, the operation detection unit 1F31 determines that the operation of supplying recording media 1H12 to the paper feeding tray 1H13 in FIG. 1 by the user, the administrator or the like is finished. Details of a timing of the operation of supplying recording media 1H12 to the paper feeding tray 1H13 in FIG. 1 will be described later.

The startup detection unit 1F32 detects, for example, a startup of the image forming apparatus 1, a startup of the CPU 1D1 in FIG. 1 or a startup of the control device 1D3 in FIG. 1. The startup is performed, for example, at the time of a power turning ON, at the time of a startup from an energy-saving mode, or at the time of so-called "wakeup" such as a restart. The startup detection unit 1F32 determines the startup, for example, by a signal for starting up the CPU 1D1 in FIG. 1 or the like.

The image formation start detection unit 1F33 includes, for example, the CPU 1D1 in FIG. 1 or the like. The image formation start detection unit 1F33 detects, for example, a start of an image formation process on each of the recording media 1H12, or a start of a process for each page for each of the recording media 1H12. Details of the detection by the image formation start detection unit 1F33 will be described later. The image formation start detection unit 1F33 determines the start, for example, by a so-called "frame reset signal" (not shown) or the like, or a signal indicating a predetermined separator in the recording medium 1H12 or the image formation process or the like.

The recording medium detection unit 1F34 detects the presence or absence of a recording medium 1H12 at a position where a sensor is placed. The recording medium detection unit 1F34 includes, for example, the sensor 1D5 in FIG. 4, the sensing control device 1D31 and the like. For example, in the case of the registration sensor 1H23 in FIG. 1, the recording medium detection unit 1F34 detects whether a recording medium 1H12 is conveyed to the position of the registration roller 1H15 in FIG. 1 by the paper feeding roller 1H14 in FIG. 1.

The conveyance unit 1F4 performs a process of conveying a recording medium 1H12 by a predetermined movement amount or to a predetermined position. The conveyance unit 1F4 includes the actuator 1D6 in FIG. 4, the drive control device 1D32 and the like.

For example, the conveyance unit 1F4 conveys the recording medium 1H12 from the paper feeding tray 1H13 in FIG. 1 to the paper feeding roller 1H14 in FIG. 1 by the paper feeding roller 1H14 in FIG. 1. For example, the conveyance unit 1F4 conveyed the recoding medium 1H12 by the predetermined movement amount from the paper feeding tray 1H13 in FIG. 1 by the paper feeding roller 1H14 in FIG. 1.

Moreover, the conveyance unit 1F4 conveys, for example, by the registration roller 1H15 in FIG. 1 the recording medium 1H12 to the secondary transfer roller 1H18 in FIG. 1 at a predetermined timing so that an image is formed at a predetermined position on the recording medium 1H12. Details of the timing will be described later.

The accommodating unit 1F5 accommodates recording media 1H12. The accommodating unit 1H5 includes, for example, the paper feeding tray 1H13 in FIG. 1 or the like. The accommodating unit 1F5 accommodates plural recording media 1H12 on which images are formed by the image forming apparatus 1. The recording medium 1H12 accommodated in the accommodating unit 1F5 is conveyed to the image forming unit 1F1 by the conveyance unit 1F4, and ejected from the image forming apparatus 1. The accommodating unit 1F5 makes plural recording media 1H12 stand by for the next image formation.

Recording media 1H12 to be accommodated in the accommodating unit 1F5 are supplied by the user, the administrator or the like. The operation for supplying by the user, the administrator or the like is performed, for example, in the case where the paper feeding tray 1H13 in FIG. 1 runs out of a recording medium 1H12, or in the case where a number of the recording media 1H12 accommodated in the paper feeding tray 1H13 becomes less than a predetermined value. Moreover, the operation of supplying by the user, the administrator or the like is performed in the case of changing a size or a kind of the recording media 1H12 on which an image is formed by the image forming apparatus 1.

In the case where the accommodating unit 1F5 is provided in the image forming apparatus 1, the accommodating unit 1F5 is provided inside the door (not shown). In the case of providing in the image forming apparatus 1, the operation for the accommodating unit 1F5 is detected by the operation detection unit 1F31.

<Timing Chart>

Figure 6:
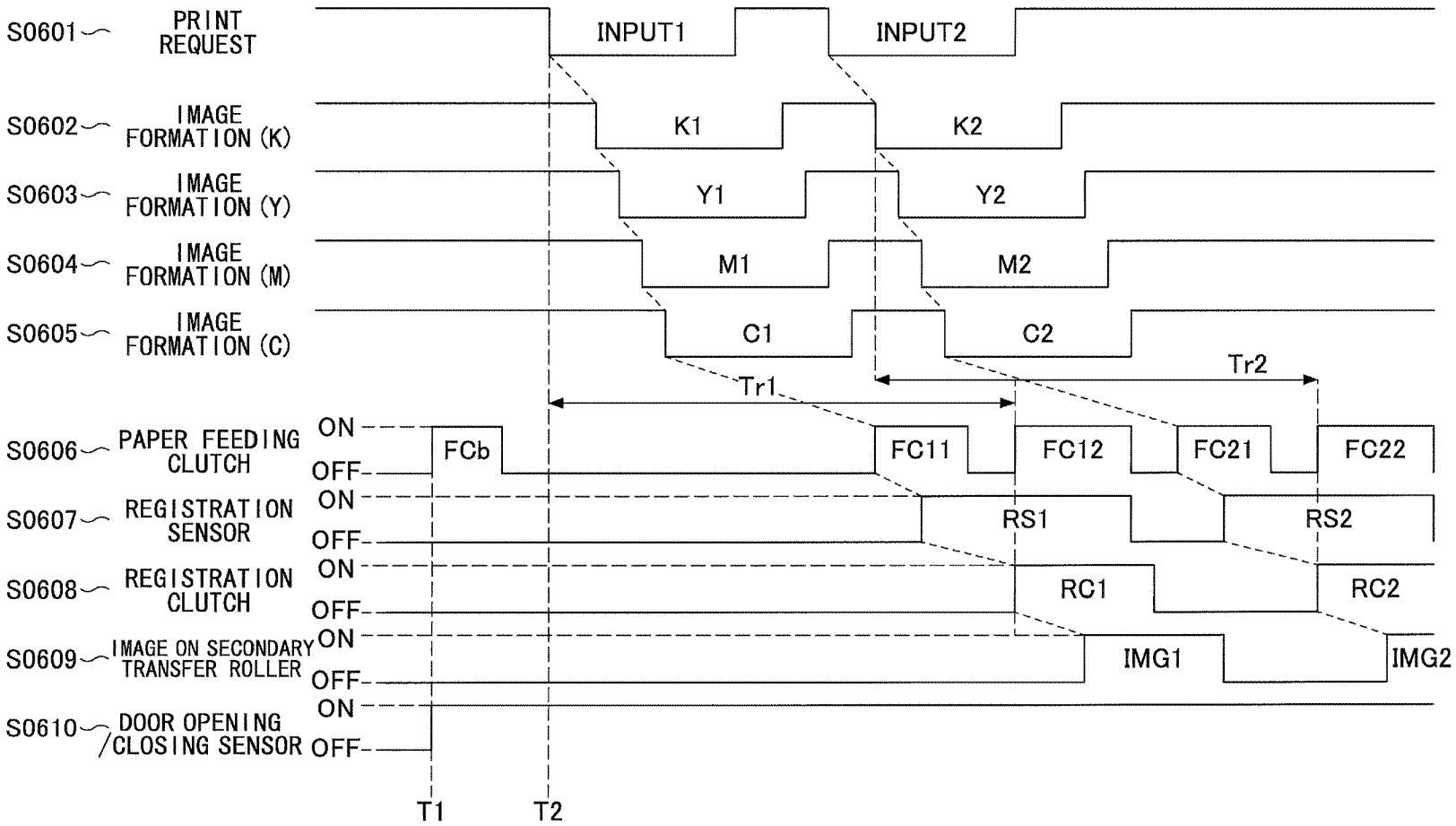
FIG. 6 is a timing chart illustrating an example of a control timing for controlling the image forming apparatus according to the first embodiment.

FIG. 6 is a timing chart for explaining an example of the control timings for controlling the image forming apparatus according to the first embodiment.

In the first embodiment, the case where the start of a process is detected by the operation detection unit 1F31 in FIG. 5 will be explained.

A signal S0601 is a signal indicating a print request. FIG. 6 illustrates an example in which two image formation requests INPUT1 and INPUT2 are input to the image forming apparatus 1 according to an instruction from the user. In the case where the print request is input, by using the input as a trigger, respective processes and the startup process of the apparatus starts. The requests INPUT1 and INPUT2 are, for example, requests for forming images on two recording media 1H12, or the like. In the following, the case where images are formed on the two recording media 1H12 will be explained. The INPUT1 and the INPUT2 will be referred to as the "first sheet" and the "second sheet", respectively.

Signals S0602 to S0605 control the image formation processes for the respective colors. According the signals S0602 to S0605 the image forming unit 1F1 performs the image formation process. The developing units of the respective colors 1H1A, 1H1B, 1H1C and 1H1D perform the primary transfer to the transfer belt 1H3. The transfer belt 1H3 is driven by the transfer belt driving roller 1H4. Therefore, the signals S0602 to S0605 include timings of starting, which are different from each other, according to a rotational speed of the transfer belt driving roller 1H4 and distances among the developing units of the respective colors 1H1A, 1H1B, 1H1C and 1H1D.

Meanwhile, the signals S0601 to S0605 are so-called "low active signals", i.e. a state in a low signal level is an asserted state.

A signal S0606 is a signal for controlling a paper feeding clutch. In the case where the signal is asserted (hereinafter, referred to as "ON"), the paper feeding clutch puts the paper feeding roller 1H14 in FIG. 1 into the state shown in FIG. 3B. Specifically, in the case where the signal S0606 is ON, the control unit 1F2 controls the clutch 14H4 in FIG. 2 to convey a recording medium 1H12 by the conveyance unit 1F4 in FIG. 5. That is, in the case where the signal S0606 is ON, the conveyance unit 1F4 in FIG. 5 causes the paper feeding roller 1H14 in FIG. 1 to convey the recording medium 1H12 to the registration roller 1H15 in FIG. 1. In the case where the signal is not asserted (hereinafter, referred to as "OFF"), the paper feeding clutch puts the paper feeding roller 1H14 in FIG. 1 into the state shown in FIG. 3A. Specifically, the rotation of the paper feeding roller 1H14 in FIG. 1 stops, and the conveyance of the recording medium 1H12 by the paper feeding roller 1H14 in FIG. 1 stops.

A signal S0607 indicates a result of detection of the recording medium 1H12 by the recording medium detection unit 1F34 in FIG. 5 at the position of the registration sensor 1H23 in FIG. 1. The signal S0607 represents, when it is high, a state of detecting the recording medium 1H12, i.e. the recording medium 1H12 exists at the position of the registration roller 1H15 in FIG. 1. The signal S0607 represents, when it is low, a state of not detecting the recording medium 1H12, i.e. the recording medium 1H12 does not exist at the position of the registration roller 1H15 in FIG. 1.

A signal S0608 is a signal for controlling a registration clutch. The signal S0608 controls the registration roller 1H15 in FIG. 1 in the same way as the signal S0606. That is, when the signal S0608 is ON, the conveyance unit 1F4 in FIG. 5 causes the registration roller 1H15 in FIG. 1 to convey the recording medium 1H12 to the secondary transfer roller 1H18 in FIG. 1. Upon conveying the recording medium 1H12, the secondary transfer is performed on the recording medium 1H12.

A signal S0609 is a signal indicating a state of an image on the secondary transfer roller. The signal S0609 indicates, when it is ON, the secondary transfer is performed. The recording medium 1H12 is conveyed to the secondary transfer roller 1H18 in FIG. 1, which is a position of the secondary transfer, from the start of the image formation process in accordance with the predetermined timing Tr1 so that an image is formed at a predetermined position on the recording medium 1H12.

A signal S0610 is a signal indicating a result of detection of opening/closing of the door (not shown) by the door opening/closing sensor 1H26 in FIG. 1. FIG. 6 illustrates the case where when the signal S0610 is high (hereinafter, referred to as "ON"), the door is closed. In FIG. 6, when the signal S0610 is low (hereinafter, referred to as "OFF"), the door is opened.

The signal S0610 detects the operation of supplying recording media 1H12 according to a timing T1 at which the open state of the door (OFF) transits to the close state of the door (ON).

Meanwhile, the signals S0606 to S0610 are so-called high active signals, i.e. a state in a high signal level is an asserted state.

In the case illustrated in FIG. 6, the image formation processes of the respective colors are performed on the INPUT1 (first sheet), i.e. the image formation K1 of the signal S0602 by the image forming unit 1F1, the image formation Y1 of the signal S0603, the image formation M1 of the signal S0604 and the image formation C1 of the signal S0605.

In the case illustrated in FIG. 6, the recording medium 1H12 as the INPUT1 (first sheet) is conveyed from the paper feeding tray 1H13 in FIG. 1 to the position of the registration roller 1H15 in FIG. 1 by the conveyance unit 1F4 in FIG. 5. The conveyance is performed during the interval FC11 of the signal S0606. When the recording medium 1H12 is conveyed to the position of the registration roller 1H15 in FIG. 1 according to the signal S0606 during the interval FC11, the recording medium 1H12 is detected and the signal S0607 turns to ON (entering an interval RS1).

Next, in accordance with the timing Tr1, the conveyance unit 1F4 in FIG. 5 conveys the recording medium 1H12 from the registration roller 1H15 in FIG. 1 to the secondary transfer roller 1H18 (hereinafter, referred to as "registration start").

The registration start is a timing at which intervals FC12 and RC1 are asserted so as to convey the recording medium 1H12 to the secondary registration roller 1H18 in FIG. 1 by the paper feeding roller 1H15 in FIG. 1 and the registration roller 1H15 in FIG. 1. The timing Tr1 for the registration start is determined based on distances from the developing units 1H1A, 1H1B, 1H1C and 1H1D to the position of the secondary transfer, a distance from the registration roller 1H15 in FIG. 1 to the position of the secondary transfer and rotational speeds of the respective rollers.

The secondary transfer is performed in an interval IMG1 of the signal S0609, i.e. the images generated during the intervals K1, Y1, M1 and C1, respectively, are transferred onto the recording medium 1H12 conveyed during the intervals FC12 and RC1.

At the timing T1 where the operation of supplying recording media 1H12 is detected by the signal S0610, the conveyance unit 1F4 in FIG. 5 starts conveying the recording medium 1H12 from the accommodating unit 1H5 in FIG. 5 by a predetermined distance during an interval FCb of the signal S0606.

Meanwhile, the timing T1 is not limited to the timing at which the signal S0610 transits from OFF to ON. For example, the interval FCb of the signal S0606 may be asserted after a predetermined period of time elapsed since the signal S0610 transits from OFF to ON.

Moreover, detection of the operation of supplying recording media 1H12 is not limited to the detection by the door opening/closing sensor 1H26 in FIG. 1. For example, the operation may be detected from a timing at which the recording medium amount sensor 1H24 in FIG. 1 detects that a predetermined amount of recording media 1H12 are added.

Figure 7B:
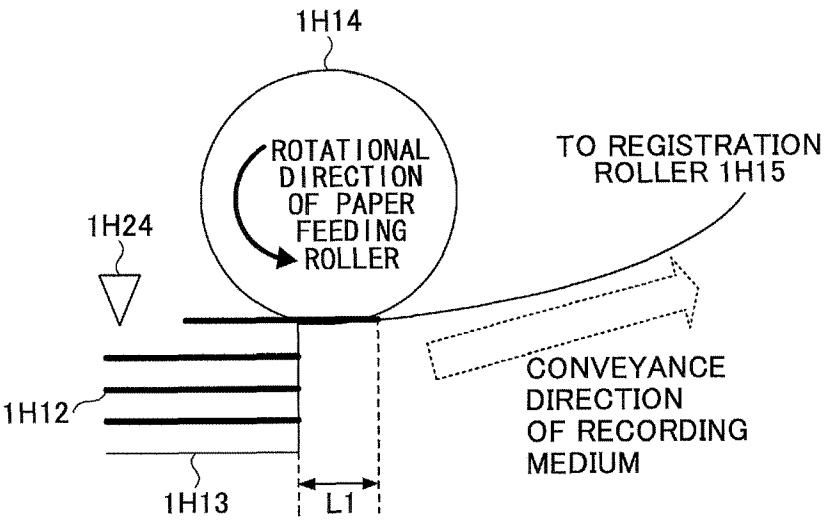
FIGS. 7A and 7B are diagrams illustrating an example of a conveyance of a recording medium by the feed roller according to the first embodiment.
Figure 7A:
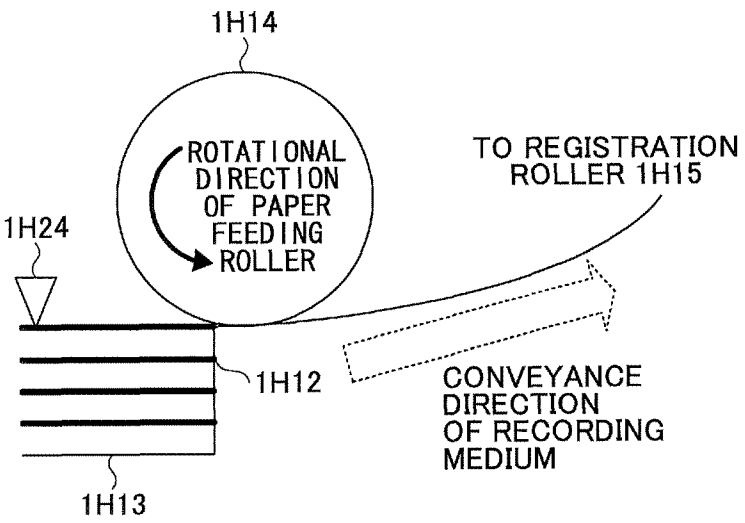

FIGS. 7A and 7B are diagrams for explaining an example of the conveyance of a recording medium by the paper feeding roller according to the first embodiment.

FIG. 7A is a diagram for explaining an example of a state where recording media 1H12 are supplied. In the case where the user or the like performs the operation of supplying recording media 1H12, the recording media are stored in the paper feeding tray 1H13 as shown in FIG. 1A. The timing at which the recording media 1H12 is stored corresponds to the timing T1.

The paper feeding roller 1H14 rotates based on the signal S0606 in FIG. 6, to convey the recording medium 1H12 from the paper feeding tray 1H13. The paper feeding roller 1H14 separates the first sheet of the plural stored recording media 1H12 from the other stored recording media by the conveyance, and conveys the first recording medium 1H12 to the registration roller 1H15 in FIG. 1.

FIG. 7B is a diagram for explaining an example of a state where the recording medium 1H12 is conveyed by the predetermined distance based on the interval FCb of the signal S0606.

In the case where the interval FCb of the signal S0606 in FIG. 6 is asserted, the paper feeding roller 1H14 rotates and conveys the recording medium 1H12 by a predetermined distance L1. The predetermined distance L1 is a value preliminarily determined by the user or the like. A time length where the interval FCb of the signal S0606 in FIG. 6 is asserted is determined from the predetermined distance L1 based on the rotational speed of the paper feeding roller 1H14.

The predetermined distance L1 is preferably a conveyance amount which is five to ten percent of a distance between the paper feeding tray 1H13 in FIG. 1 and the registration sensor 1H23 in FIG. 1.

In the following, the case where the distance between the paper feeding tray 1H13 in FIG. 1 and the registration sensor 1H23 in FIG. 1 is 75 millimeters and a conveyance speed by the paper feeding roller 1H14 is 150 millimeters per second will be explained as an example.

Since a length of 5 percent of the distance between the paper feeding tray 1H13 in FIG. 1 and the registration sensor 1H23 in FIG. 1 is 3.75 millimeters and the length of 10 percent of the distance between the paper feeding tray 1H13 in FIG. 1 and the registration sensor 1H23 in FIG. 1 is 7.5 millimeters, the predetermined distance L1 may be determined to be 5 millimeters, for example.

In this case where the predetermined distance is 5 millimeters, the assert time of the interval FCb of the signal S0606 is obtained by dividing 5 millimeters by 150 millimeters per second, i.e. 0.033 seconds (rounded to the third decimal place).

In the case where the predetermined distance L1 is 5 to 10 percent of the distance between the paper feeding tray 1H13 and the registration sensor 1H23 in FIG. 1, the recording medium 1H12 is easily engaged with the paper feeding roller 1H14. Furthermore, a detection of the recording medium 1H12 by the registration sensor 1H23 can be prevented.

By the paper feeding roller 1H14 rotating based on the signal S0606 in FIG. 6 to convey the recording medium 1H12 by the predetermined distance L1 from the paper feeding tray 1H13, so-called "nip state" where the recording medium 1H12 is engaged with the paper feeding roller 1H14 sufficiently is generated.

In the case where the signal S0607 of the registration sensor in FIG. 6 does not transit to ON, i.e. the interval RS1 does not start within a predetermined time from when the paper feeding clutch transits to ON, i.e. the interval FC11 starts, the image forming apparatus 1 determines that a jam occurs and detects an error.

In the state shown in FIG. 7B, since the conveyance has been performed preliminarily by the predetermined distance L1, the conveyance distance can be shortened, and a time for conveying from the paper feeding roller 1H14 to the registration roller 1H15 in FIG. 1 can be made shorter. That is, since in the state shown in FIG. 7B, compared with the case of starting the conveyance from the state shown in FIG. 7A, a margin time for detecting an error due to the jam can be set longer, an erroneous detection of a jam can be prevented.

Moreover, since compared with the method of preventing the erroneous detection of a jam by setting a longer time for determining a jam, it is unnecessary to set a long time in the present embodiment, the paper feeding time can be made shorter.

In the case of detecting the operation for supplying recording media 1H12, by asserting the FCb of the signal S0606 based on the detection and conveying a recording medium 1H12 by the predetermined distance L1 from the paper feeding tray 1H13, the erroneous detection of a jam can be prevented.

<Second Embodiment>

In a second embodiment, the image forming apparatus 1 according to the first embodiment is used. Thus, an explanation of the image forming apparatus 1 will be omitted. In the following, a configuration, a process, a signal and a function, which are the same as those in the first embodiment, respectively, will be explained with the same reference numeral and name.

A control method according to the second embodiment is different from the control method according to the first embodiment, which is illustrated in FIG. 6.

Figure 8:
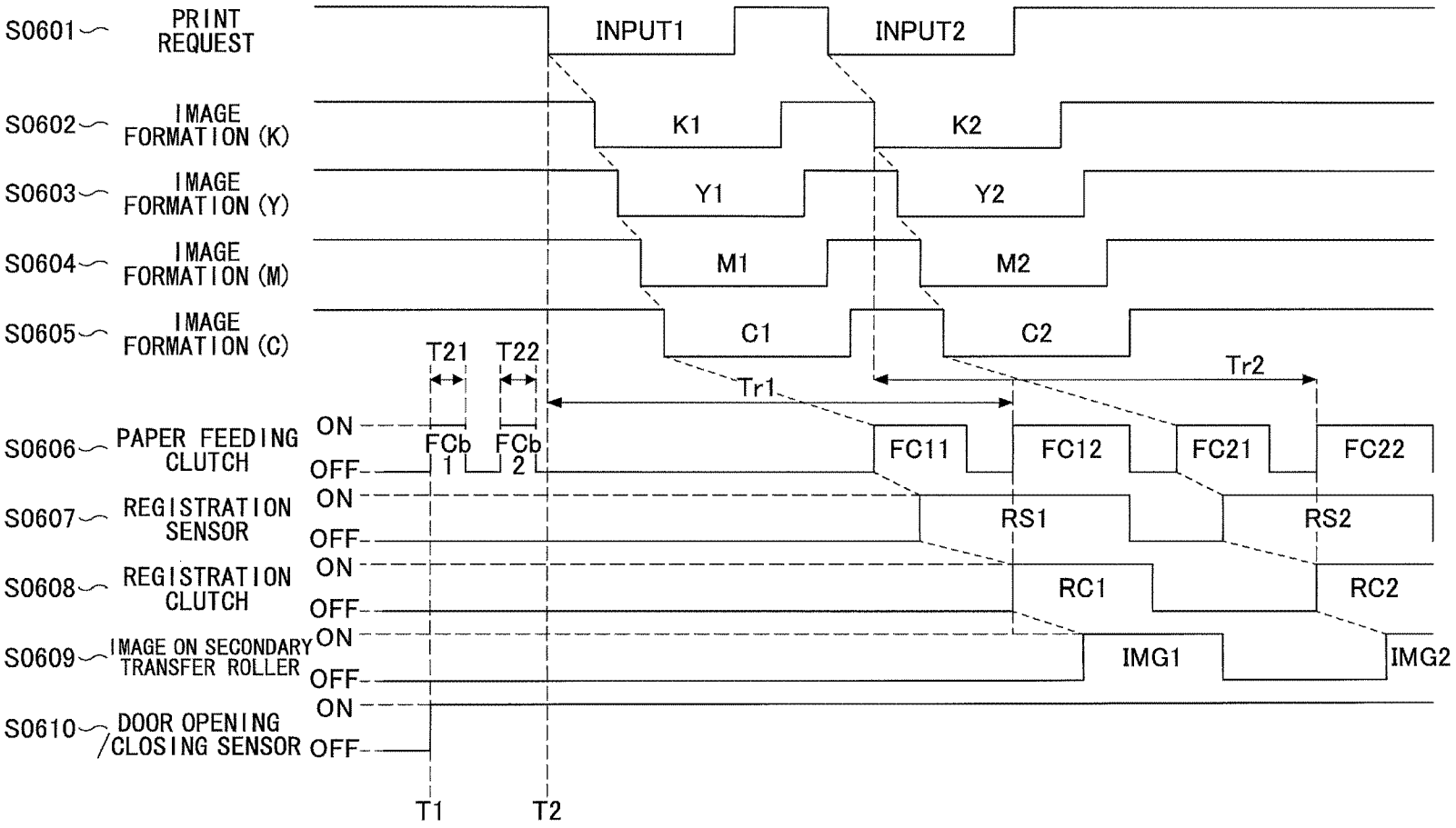
FIG. 8 is a timing chart illustrating an example of a control timing for controlling an image forming apparatus according to a second embodiment.

FIG. 8 is a timing chart for explaining an example of the control timings for controlling the image forming apparatus according to the second embodiment.

In FIG. 8, since signals S0601 to S0610 are the same as the signals S0601 to S0610 according to the first embodiment, the same name and reference numeral are used for the explanation.

FIG. 8 is different from FIG. 6 in the first embodiment in that the interval FCb of the signal S0606 is divided into FCb1 and FCb2 and asserted. In the following, explanations of the same parts as the first embodiment will be omitted.

In the second embodiment, the interval FCb of the signal S0606 in FIG. 6 according to the first embodiment is divided into plural intervals, and the recording media 1H12 are conveyed by the predetermined distance L1 from the paper feeding tray 1H13 plural times.

For example, a total of a time length T21 for asserting FCb1 and a time length T22 for asserting FCb2 corresponds to that for FCb of the signal S0606 in FIG. 6.

The paper feeding roller 1H14 in FIG. 1 is in a state where the rotation stops in the case where the signal S0606 is not asserted (OFF). In the case of starting the conveyance of a recording medium 1H12 by the signal S0606 being asserted from the stop state, since it is in the stop state, a frictional force between the paper feeding roller 1H14 and the recording medium 1H12 occurs according to a static friction coefficient.

Since the static friction coefficient is greater than a dynamic friction coefficient, the paper feeding roller 1H14 in FIG. 1 conveys the recording medium 1H12 with a greater force according to the static friction coefficient, and a success rate for paper feeding can be enhanced.

Meanwhile, the divided conveyances according to the present embodiment are not limited to two conveyances FCb1 and FCb2. For example, the interval FCb of the signal S0606 in FIG. 6 according to the first embodiment may be divided into three or more intervals.

Moreover, the time lengths of T21 and T22 are not limited to the case where the total of T21 and T22 corresponds to that of FCb of the signal S0606 in FIG. 6. For example, according to the division, the recording media 1H12 can be conveyed with a greater force and a required time can be made shorter. Thus, the total of T21 and T22 may be shorter than FCb of the signal S0606 in FIG. 6.

<Third Embodiment>

In the third embodiment, the image forming apparatus 1 according to the first embodiment is used. Thus, an explanation of the image forming apparatus 1 will be omitted. In the following, a configuration, a process, a signal and a function, which are the same as those in the first embodiment, respectively, will be explained with the same reference numeral and name.

A control method according to the third embodiment is different from the control method according to the first embodiment, which is illustrated in FIG. 6.

Figure 9:
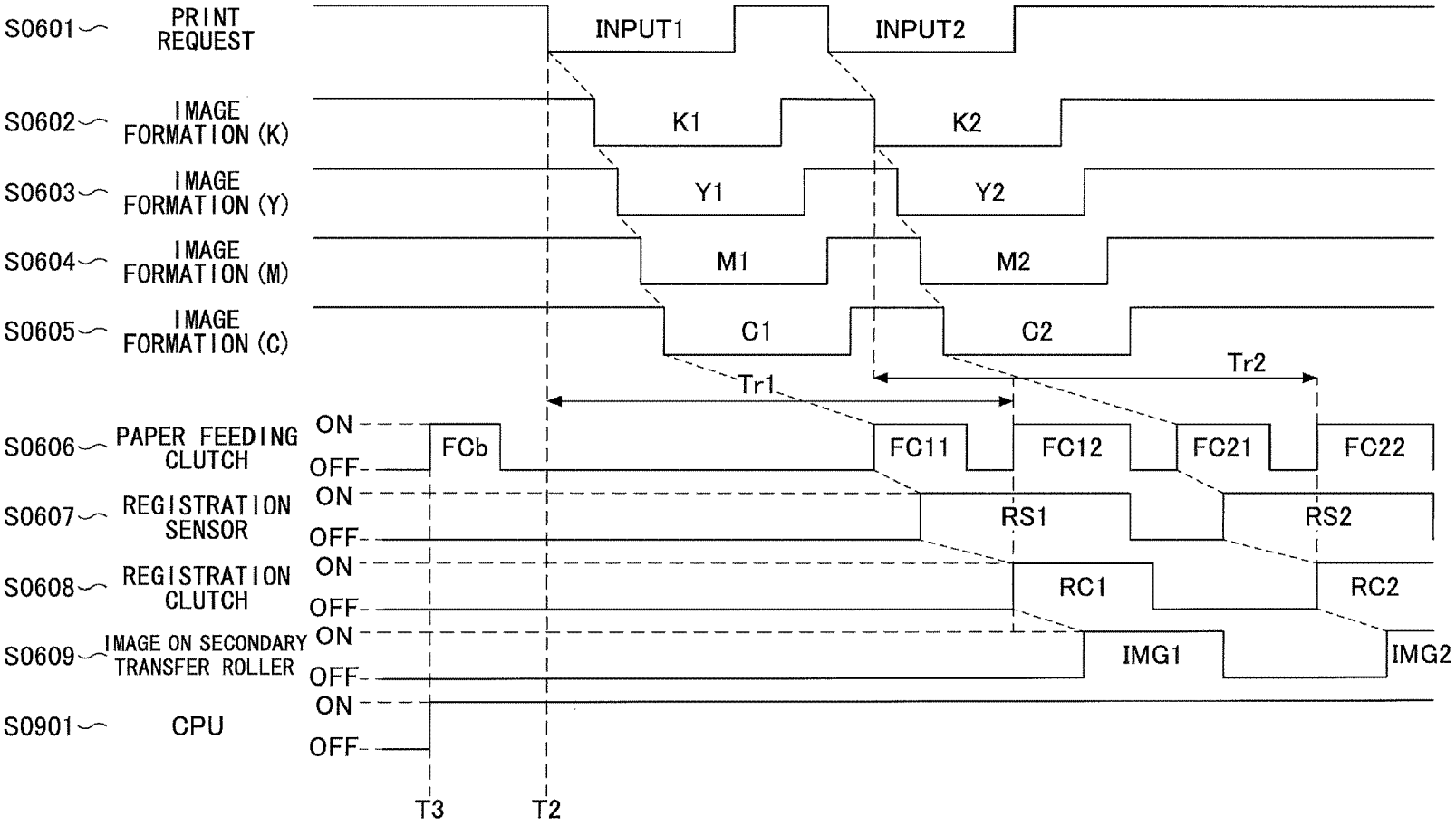
FIG. 9 is a timing chart illustrating an example of a control timing for controlling an image forming apparatus according to a third embodiment.

FIG. 9 is a timing chart for explaining an example of the control timings for controlling the image forming apparatus according to the third embodiment.

In FIG. 9, since signals S0601 to S0610 are the same as the signals S0601 to S0610 according to the first embodiment, the same name and reference numeral are used for the explanation.

FIG. 9 is different from FIG. 6 in the first embodiment in that a signal S0901 is used instead of the signal S0606. In the following, explanations of the same parts as the first embodiment will be omitted.

In the third embodiment, an activation of the control unit 1F2 in FIG. 5 (the control unit 1F2 is started up) is detected by the signal S0901, and the detected timing is substituted for the timing T1 at which the operation for supplying recording media 1H12 is detected in the first embodiment.

The signal S0901 is, for example, a signal indicating low for a state where a CPU is stopped (OFF) and indicating high for a state where the CPU operates (ON).

A timing T3, at which the signal S0901 transits from low to high, is substituted for the timing T1, at which the operation of supplying recording media 1H12 in the first embodiment is detected, and is used as a trigger, and FCb of the signal S0606 is asserted. In the same way as in the first embodiment, by FCb of the signal S0606 being asserted, the conveyance explained in FIGS. 7A and 7B is performed.

Meanwhile, the signal S0901 is not limited to a signal indicating an operation state of the CPU and a stopped state. For example, a startup state of middleware such as an electric power supply or an OS (operating system) may be used. Furthermore, in the signal S0901 a so-called "energy saving mode" state, i.e. a state in which an electric power supply to the CPU or the like is less than or equal to a predetermined value, may be assigned to OFF.

Since in the case where the CPU is OFF the detection result cannot be acquired from the sensor 1D5 in FIG. 4, the operation of supplying recording media 1H12 cannot be detected.

In the case of detecting the startup of the CPU, FCb of the signal S0606 is asserted based on the detection and a recording medium 1H12 is conveyed by the predetermined distance L1 from the paper feeding tray 1H13, thereby an erroneous detection of a jam can be prevented.

<Fourth Embodiment>

In a fourth embodiment, the image forming apparatus 1 according to the first embodiment is used. Thus, an explanation of the image forming apparatus 1 will be omitted. In the following, a configuration, a process, a signal and a function, which are the same as those in the first embodiment, respectively, will be explained with the same reference numeral and name.

A control method according to the fourth embodiment is different from the control method according to the first embodiment, which is illustrated in FIG. 6.

Figure 10:
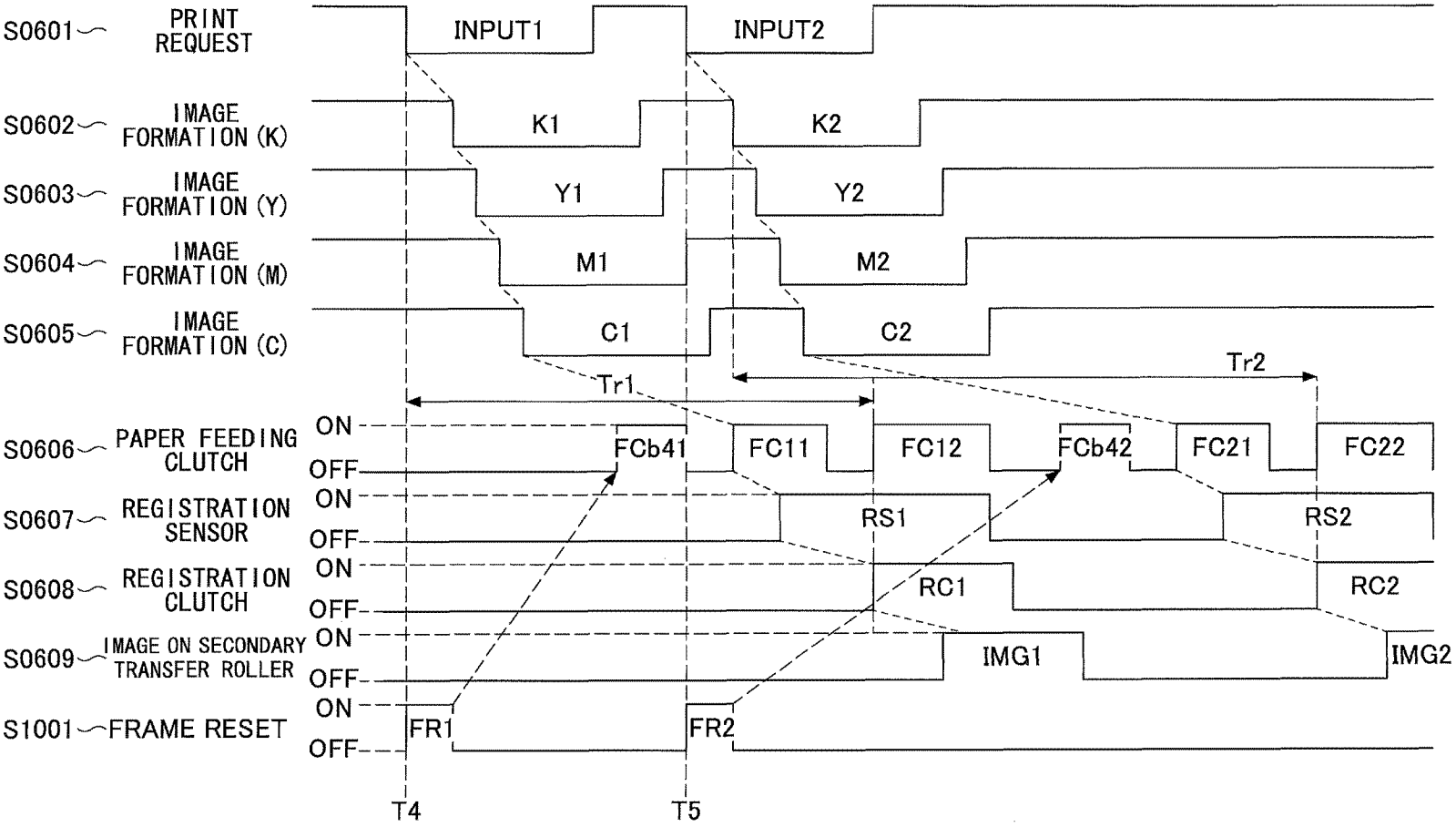
FIG. 10 is a timing chart illustrating an example of a control timing for controlling an image forming apparatus according to a fourth embodiment.

FIG. 10 is a timing chart for explaining an example of the control timings for controlling the image forming apparatus according to the fourth embodiment.

FIG. 10 is different from FIG. 6 in the first embodiment in that a signal S1001 is used instead of the signal S0606. In the following, explanations of the same parts as the first embodiment will be omitted.

In the fourth embodiment, a startup for each page of the recording media 1H12 is detected by the signal S1001, and the detected timing is substituted for the timing T1 at which the operation for supplying recording media 1H12 is detected in the first embodiment.

The signal S1001 is a so-called "high active signal", i.e. at the time when the print request for each page starts, for example, the signal turns to high, wherein a state in a high signal level is an asserted state.

The signal S1001 is a so-called "frame reset signal", which turns to active every time the signal S0601 is asserted.

In the case of FIG. 10, at a timing T4 where INPUT1 is asserted or at a timing T5 where INPUT2 is asserted, the signal S1001 also transits to the asserted state, and a start of each image formation process is detected.

The timings T4 and T5, at which the signal S1001 transits from low to high, are substituted for the timing T1, at which the operation of supplying recording media 1H12 in the first embodiment is detected, and are used as triggers, and FCb41 and FCB42 of the signal S0606 are asserted, respectively. In the same way as in the first embodiment, by FCb of the signal S0606 being asserted, the conveyance explained in FIGS. 7A and 7B is performed.

In the case where the first recording medium 1H12 is conveyed from the paper feeding tray 1H13, the second recording medium may be conveyed according to the friction by the first recording medium 1H12 which is conveyed. That is, a so-called "double feed" occurs.

The conveyance according to the "double feed" may not be performed sufficiently. Therefore, in the present embodiment, a recording medium 1H12 is conveyed based on FCb41 and FCB42 of the signal S0606 for each page. A recording medium 1H12 is conveyed by the predetermined distance L1 from the paper feeding tray 1H13 for each page, thereby an erroneous detection of a jam can be prevented.

<Fifth Embodiment>

Figure 11:
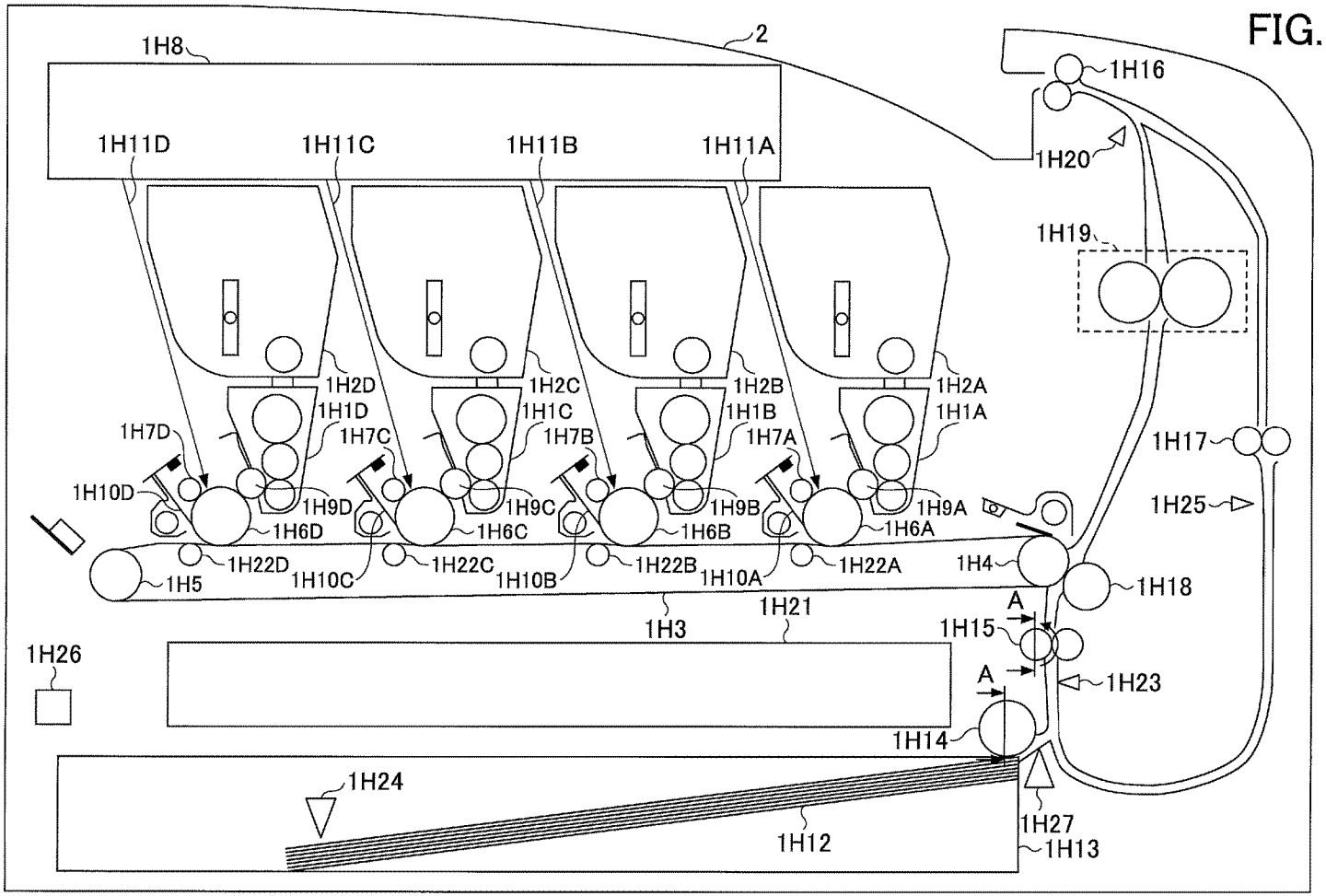
FIG. 11 is a diagram illustrating an example of an entire configuration of an image forming apparatus according to a fifth embodiment.

FIG. 11 is a diagram for explaining an example of an entire configuration of an image forming apparatus according to a fifth embodiment.

In the fifth embodiment, an image forming apparatus 2 is used instead of the image forming apparatus 1 according to the first embodiment. In the following, a configuration, a process, a signal and a function, which are the same as those in the first embodiment, respectively, will be explained with the same reference numeral and name.

The image forming apparatus 2 includes a conveyance amount sensor 1H27 in addition to the configuration of the image forming apparatus 1.

The conveyance amount sensor 1H27 is placed at a position of a distance, which the conveyance is allowed by the conveyance explained in FIGS. 7A and 7B from the paper feeding tray 1H13, for example. The allowable distance is a distance which allows the recording medium 1H12 from the paper feeding tray 1H13 by the conveyance explained in FIGS. 7A and 7B. In the case of conveying by the allowable distance or more, the conveyance amount sensor 1H27 detects the recording medium 1H12.

In the case where the conveyance amount sensor 1H27 performs the detection, at the timing T1 in FIG. 6 in the first embodiment, at the timing T3 in the third embodiment and at the timings T4 and T5 in FIG. 10 in the fourth embodiment, FCb in the signal S0606 is not asserted, i.e. the conveyance of the recording medium 1H12 is stopped.

For example, in the third embodiment, in the case where the restart of the CPU is performed many times, the conveyance from the paper feeding tray 1H13 may be performed by the conveyance explained in FIGS. 7A and 7B.

In the case of detecting the conveyance by the allowable distance or more, the conveyance of the recording medium 1H12 is stopped, thereby an erroneous detection of a jam, in which the conveyance is performed more than necessary and the recording medium reaches the registration sensor 1H23, for example, can be prevented.

The present embodiment is not limited to the method by the paper feeding tray, but may be applied to a method of a so-called "manual paper feeding", for example.

The present embodiment can be applied to an apparatus in which recording media are accommodated and conveyed, and is not limited to the tandem system illustrated in the embodiments.

The image forming apparatus 1 may be, for example, a facsimile apparatus, a printing apparatus (printer), a copying apparatus, a multifunction peripheral or the like.

Further, the present invention is not limited to these embodiments, but various variations and modifications may be made without departing from the scope of the present invention.

The present application is based on and claims the benefit of priority of Japanese Priority Application No. 2014-012645 filed on Jan. 27, 2014, the entire contents of which are hereby incorporated by reference.

What is claimed is:

1. An image forming method in an image forming apparatus including a door, a storage unit for storing a recording medium and a registration sensor for detecting the recording medium, the method comprising:

conveying the recording medium from the storage unit toward the registration sensor;

performing, based on a print instruction, an image formation for forming an image to be transferred onto the recording medium conveyed from the storage unit;

detecting, before the print instruction occurs, whether the door is in a closed state or an open state;

conveying, before the print instruction occurs, the recording medium by a distance from the storage unit in response to detecting that the door is in the closed state after detecting that the door is in an opened state; and stopping, before the print instruction occurs, the recording medium at the distance.

2. The image forming method in an image forming apparatus as claimed in claim 1 further comprising:

detecting the recording medium.

3. The image forming method in an image forming apparatus as claimed in claim 1 further comprising:

detecting a recording medium presence at a location at which the recording medium is conveyed from the storage unit, and stopping the conveyance of the recording medium when a positon of the recording medium is at or beyond the location.

4. The image forming method in an image forming apparatus as claimed in claim 1, further comprising moving the recording medium a plurality of times by divided distances, a sum of the divided distances being equal to the distance.

5. The image forming method in an image forming apparatus as recited in claim 1, further comprising initiating an error signal when the registration sensor does not detect the recording medium before a timer expires.

6. The image forming method in an image forming apparatus as recited in claim 1, further comprising setting a timer based on a distance between the moved recording medium and the registration sensor.

7. The image forming method in an image forming apparatus as claimed in claim 1 further comprising:

stopping conveyance of the recording medium after detecting the closed state and before performing any image formation.

8. The image forming method in an image forming apparatus as claimed in claim 1, wherein the conveying and the stopping are independent of any print instruction.

9. The image forming method in an image forming apparatus as claimed in claim 1, wherein the print instruction is an image formation request by an instruction of a user.

* * * * *